US007249582B2

(12) United States Patent
Kawarai et al.

(10) Patent No.: US 7,249,582 B2
(45) Date of Patent: Jul. 31, 2007

(54) INTAKE APPARATUS

(75) Inventors: Hiroyuki Kawarai, Odawara (JP); Kazuyori Kito, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/573,897

(22) PCT Filed: Oct. 5, 2004

(86) PCT No.: PCT/JP2004/014631

§ 371 (c)(1),
(2), (4) Date: Mar. 29, 2006

(87) PCT Pub. No.: WO2005/035968

PCT Pub. Date: Apr. 21, 2005

(65) Prior Publication Data

US 2007/0113815 A1 May 24, 2007

(30) Foreign Application Priority Data

Oct. 8, 2003 (JP) ..... 2003-349519

(51) Int. Cl.
*F02M 31/00* (2006.01)

(52) U.S. Cl. ..... 123/184.21; 123/184.57; 123/198 E

(58) Field of Classification Search ..... 123/184.21, 123/184.57, 198 E; 181/229
See application file for complete search history.

(56) References Cited

U.S. PATENT DOCUMENTS 5,575,247 A * 11/1996 Nakayama et al. .... 123/184.21
2003/0154951 A1 8/2003 Nakamura et al.

FOREIGN PATENT DOCUMENTS

| | | |
|---|---|---|
| JP | 2-72356 | 6/1990 |
| JP | 2000-227057 | 8/2000 |
| JP | 2002-206465 | 7/2002 |
| JP | 2003-184671 | 7/2003 |
| JP | 2003-239815 | 8/2003 |

* cited by examiner

*Primary Examiner*—Noah P. Kamen
(74) *Attorney, Agent, or Firm*—Wenderoth, Lind & Ponack, L.L.P.

(57) ABSTRACT

The present invention provides an intake apparatus which ensures the collision safety by having sufficient clearance margin to the engine hood by utilizing the space around the intake manifold which is not conventionally utilized, while achieving cost reduction by reduction in parts count and assembling time.

The third member 14 covers the first member 10 in which the first room 24 is formed and the second member 12 in which the second room 38 is formed. The third room 54 which is formed in the third member 14 connects the first room 24 and the second room 38. With this structure, the second room 38 can be disposed adjacent to the first room 24 at almost the same height. Consequently, the height of the intake apparatus can be lowered, and the clearance between the intake apparatus and the engine hood can be enlarged. In addition, the intake air amount can be increased.

15 Claims, 9 Drawing Sheets

INTAKE APPARATUS

TECHNICAL FIELD

The present invention relates to an intake apparatus to supply air to an internal combustion engine.

BACKGROUND ART

An intake apparatus for supplying air to an internal combustion engine mainly comprises an air cleaner, a throttle body, and an intake manifold. A conventional intake apparatus is disclosed in Japanese Patent Laid-Open 2003-184671 (Page 2-4, FIG. 1). The conventional intake apparatus is shown in FIG. 8 and FIG. 9. A resonator 76 and an air cleaner 74 having an inlet duct 72 are disposed above an engine (a cylinder block) 70. The air cleaner 74 and the resonator 76 are connected through a connecting member 78 such as a pipe, a flexible tube, etc. A throttle body 82 having a throttle valve 80 is disposed at the side of the air cleaner 74. The air cleaner 74 and the throttle body 82 are connected through a connecting member 84 such as a pipe, a flexible tube, etc. An intake manifold module 90 consisting of an intake manifold 86 and an upper body 88 which is the upper portion thereof is disposed at the side of the throttle body 82. The throttle body 82 and the upper body 88 are connected through a connecting member 92 such as a pipe, a flexible tube, etc. The intake manifold 86 is connected directly to the engine 70.

The air which is supplied to the engine 70 is introduced to an air cleaner room 75 in the air cleaner 74 through the inlet duct 72. Then, the air is introduced to the throttle body 82 through the air cleaner room 75 after eliminating dust etc. by a filter (not shown in drawings) which is disposed in the air cleaner room 75. Then, the air is introduced to the engine 70 in the order of the throttle body 82, the upper body of the intake manifold module 90 and the intake manifold 86.

Many parts are installed in the limited volumetric capacity of an engine room of an automobile. Therefore, reduction in parts count, the volume of each part, and the assembling time are continuously desired for apparatuses and parts which are installed in an engine room. From this viewpoint, with the structure having an air cleaner 74 above the engine 70 as shown in FIG. 8 and FIG. 9, a technology to integrate a cylinder head cover of an engine (a cylinder block) and an air cleaner body is disclosed in Japanese Patent Laid-Open 2002-206465 (Page 2-3, FIG. 1). By integrating the cylinder head cover of the engine and the air cleaner body, reduction in parts count and assembling time, and space saving of the engine room can be achieved.

As shown in FIG. 8 and FIG. 9, the upper body 88 which positions above the circular-shaped intake manifold 86 is disposed at a position being apart in the horizontal direction from the air cleaner 74 which positions vertically above the engine 70. The throttle body 82 is disposed between the air cleaner 74 and the upper body 88 which are apart in the horizontal direction. In the space V between the air cleaner 74 and the upper body 88, namely the space at which the throttle body 82 is disposed, considerable room is not utilized except for the room for disposing the throttle body 82.

In the prior art, the connecting member 84 is adopted for connecting the air cleaner 74 and the throttle body 82, and the connecting member 92 is adopted for connecting the throttle body 82 and the intake manifold module 90. These connecting members 84, 92 are disposed in the horizontal direction. Therefore, the width of the space V in FIG. 8 increases, and there exists useless room which is not used effectively in the space V.

Intake noise is generated in the air cleaner 74. From the viewpoint of quietness of the vehicle, the air cleaner room 75 has to be larger than a specific volume to lower the intake noise at the air cleaner 74. In order to ensure the specific volume of the air cleaner 75, enlarging the side face of the air cleaner 74 is considered. However, around the side face of the air cleaner 74, specific parts such as the intake manifold module 90 are to be disposed at the same height. Therefore, to ensure the specific volume of the air cleaner room 75, the height of the air cleaner 74 which is attached to the engine 70 has to be necessarily high. Consequently, the adequate margin of the clearance between the air cleaner 74 and the engine hood (not shown in figures) cannot be obtained. Then, in the case of collision, the possibility that the reliability of the air cleaner 74 and the intake manifold module 90 may not be ensured cannot be denied due to the possibility of the impact caused of the air cleaner 74 and impact damage of the intake manifold module 90 etc. Further, since the margin between the air cleaner 74 and the engine hood is not adequate, there is a drawback that the impact to a pedestrian becomes large if the vehicle hits a pedestrian. In addition, when the same intake apparatus is installed to a mini car, the clearance margin between the air cleaner and the engine hood becomes extremely insufficient.

The present invention was devised in view of the abovementioned problems. The object of the present invention is to provide an intake apparatus which ensures the collision safety by having sufficient clearance margin to the engine hood by utilizing the space around the intake manifold which is not conventionally utilized, while achieving cost reduction by eliminating superfluous connecting members which reduces parts count and assembling time.

DISCLOSURE OF THE INVENTION

To achieve the abovementioned object, an intake apparatus for supplying air to an engine of the present invention comprises a first member which is disposed above the engine having a first room connecting to the atmospheric air, a second member having a throttle body and a second room which is connected to the engine, and a third member for covering the first room of the first member and the second room of the second member having a third room to connect the first room and the second room, wherein at least one of the second room and the third room is disposed adjacent to the first room. In an intake apparatus of the present invention, the throttle body is disposed in the second room. In an intake apparatus of the present invention, the second room of the second member is connected to the engine through the throttle body and an intake manifold. In an intake apparatus of the present invention, the first member comprises a resonator which connects to the first room. In an intake apparatus of the present invention, the first member serves also as a cylinder head cover of the engine and is attached to the engine. In an intake apparatus of the present invention, the first room is formed as a concave of the first member. In an intake apparatus of the present invention, the second room is formed as a concave of the second member. In an intake apparatus of the present invention, the third member comprises a first region space which connects to the first room, a second region space which connects to the second room, and a connecting passage which connects the first region space and the second region space. In an intake apparatus of the present invention, the first region space and the second region space are formed as a concave at the third member. In an intake apparatus of the present invention, a filter is disposed in the first room of the first member. In an intake apparatus of the present invention, a filter is attached to the third member at a position facing the first room. In an intake apparatus of the present invention, a control means is attached to the third member. In an intake apparatus of the present invention, the first member has a first fit means and the second member has a second fit means for fitting with the first fit member. In an intake apparatus of the present invention, a recess portion is formed at one of the second member and the third member, and a convex-shaped seal member is attached to the other of the second member and the third member, at the connecting portion of the second member and the third member. The seal member is fitted to the recess portion while the depth of fitting is adjustable. The connecting portion between the first member and the third member is on a plane which is parallel to the perpendicular direction to the fitting direction of the recess portion and the convex-shaped seal member. A seal member is sandwiched at the connecting portion of the first member and the third member which are free to relatively be adjusted in the parallel direction of each member at the sandwiching position. In an intake apparatus of the present invention, a recess portion is formed at one of the first member and the third member, and a convex-shaped seal member is attached to the other of the first member and the third member, at the connecting portion of the first member and the third member. The seal member is fitted to the recess portion while the depth of fitting is adjustable. The connecting portion between the second member and the third member is on a plane which is parallel to the perpendicular direction to the fitting direction of the recess portion and the convex-shaped seal member. A seal member is sandwiched at the connecting portion of the second member and the third member which are free to relatively be adjusted in the parallel direction of each member at the sandwiching position.

BEST MODE FOR CARRYING OUT THE INVENTION

Figure 1:
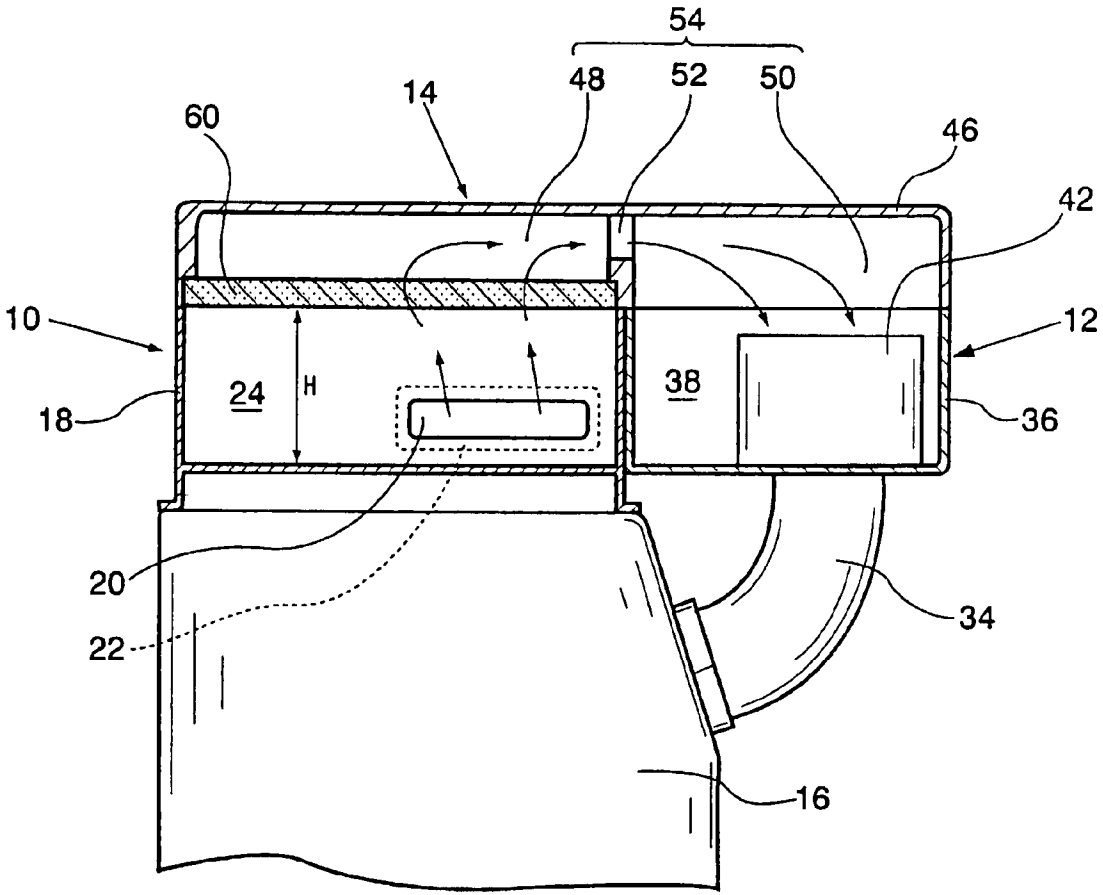
FIG. 1 is a sectional view of an intake apparatus of the present invention.
Figure 2:
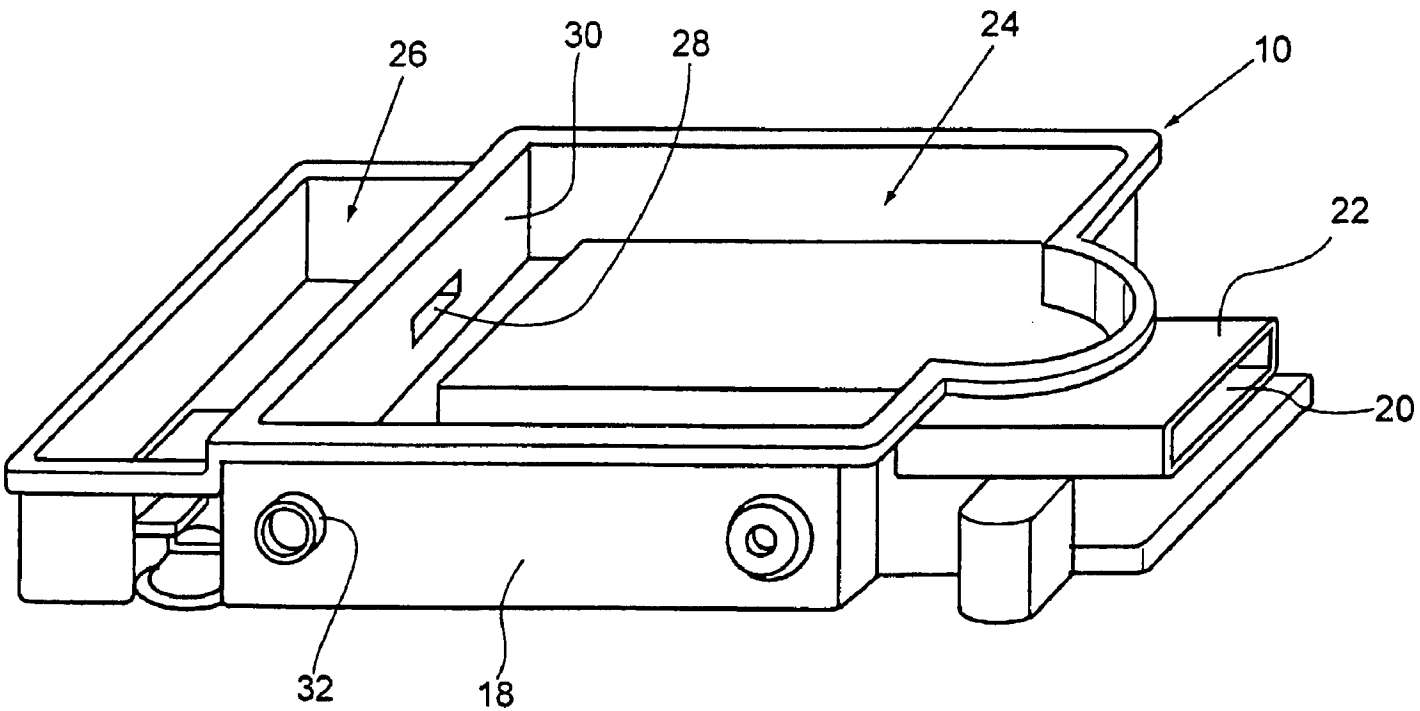
FIG. 2 is a perspective view of a first member for the intake apparatus of the present invention.
Figure 3:
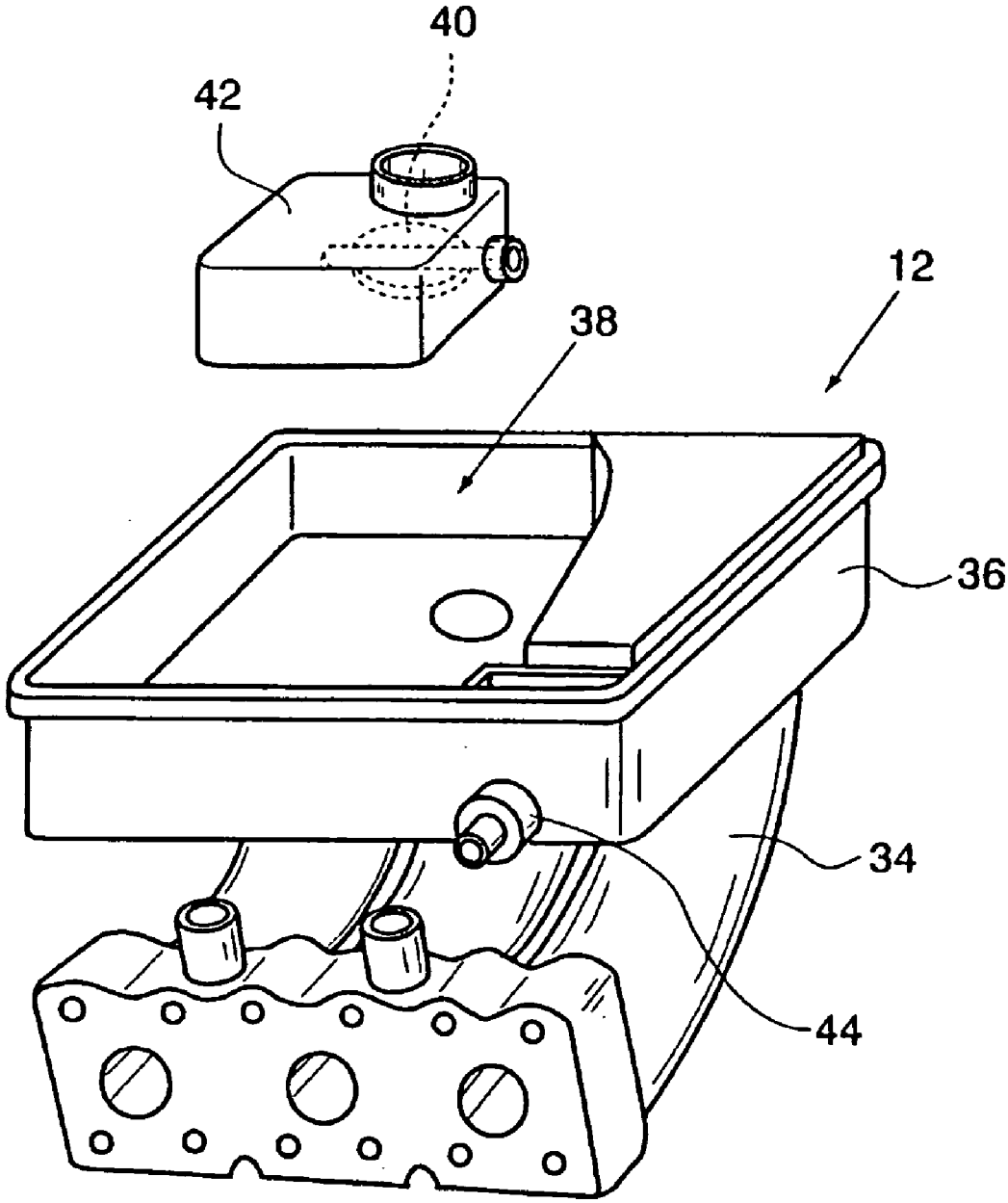
FIG. 3 is a perspective view of a second member for the intake apparatus of the present invention.
Figure 4:
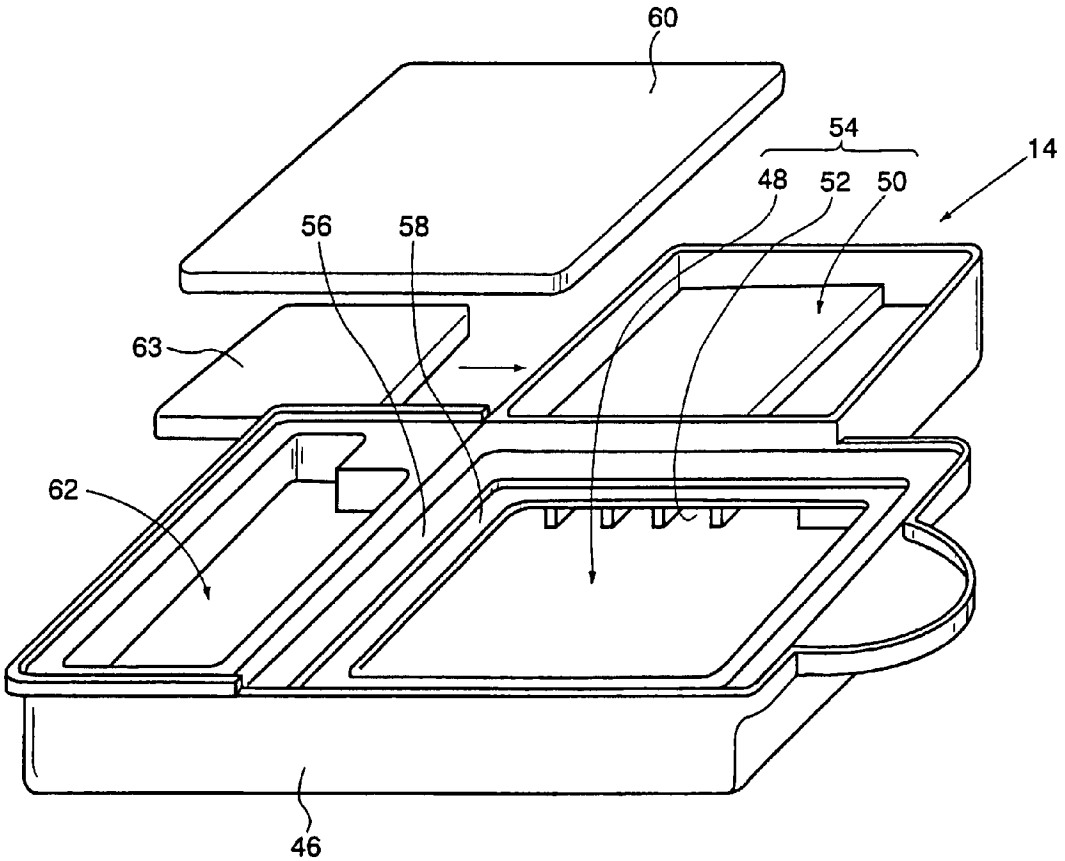
FIG. 4 is a perspective view of a third member for the intake apparatus of the present invention.

The present invention is explained in the following based on the drawings. FIG. 1 is a sectional view of a main part showing an embodiment of an intake apparatus of the present invention. FIG. 2 is a perspective view of a first member for the intake apparatus of FIG. 1. FIG. 3 is a perspective view of a second member for the intake apparatus of FIG. 1. FIG. 4 is a perspective view of a third member for the intake apparatus of FIG. 1. The intake apparatus of the present invention mainly comprises the first member 10 which is shown in FIG. 2, the second member 12 which is shown in FIG. 3, and the third member 14 which is shown in FIG. 4. The first member 10, the second member 12 and the third member 14 are preferred to be made of synthetic resin, but it is not limited to the material.

As shown in FIG. 1, the first member 10 in FIG. 2 is attached above an engine (a cylinder block) 16. It is possible that a body 18 of the first member 10 serves as a cylinder head cover of the engine and a cleaner case. As shown in FIG. 2, the body 18 of the first member 10 integrally has a duct portion 22 in which an air introducing passage 20 is formed inside to connect to the atmospheric air. A first room 24 and a resonator 26 to reduce at a specific frequency are formed in the first member 10. The first room 24 and the resonator 26 are formed as a concave of the body 18. The first room 24 is directly connected to the air introducing passage 20, and is an intake enlarging room as the room is larger than the intake introducing passage 20. The first room 24 and the resonator 26 are sectioned by a partition wall 30 in which a connecting passage 28 is formed. The first room 24 and the resonator 26 are connected through the connecting passage 28. The section of the connecting passage 28 is varied by a valve (not shown in figures). A cylindrical first fit means 32 which projects to the outside is formed at the side wall of the body 18. A connecting means is necessary when the air cleaner and the resonator are disposed separately as the prior art. However, by forming the first room 24 and the resonator 26 integrally at the body 18 of the first member 10, the connecting means is eliminated. Therefore, space saving of the engine room and cost reduction can be achieved.

As shown in FIG. 1 and FIG. 3, a second room 38 is formed at a body 36 of the second member 12, and a throttle body 42 having a throttle valve 40 is accommodated in the second room 38. The second room 38 of the body 36 is formed as a concave. One end of an intake manifold 34 is attached to the lower side of the second member 12, and the other end of the intake manifold 34 is connected and fixed to the engine 16. The throttle body 42 is arranged to communicate with the intake manifold 34. A second fit means 44 for witting with the first fit means 32 is formed at the outer side wall of the body 36.

A third member 14 shown in FIG. 4 is to cover the upper faces of the first member 10 and the second member 12. In particular, the third member 14 covers the open portion of the first room 24 of the first member 10, the open portion of the resonator 26, and the open portion of the second room 38 of the second member 12. A first region space 48 for connecting to the first room 24 of the first member 10 and a second region space 50 for connecting to the second room 38 of the second member 12 are formed at a body 46 of the third member 14. The first region space 48 and the second region space 50 are formed as a concave. The first region space 48 and the second region space 50 are connected through a connecting passage 52. A third room 54 consists of the first region space 48, the second region space 50 and the connecting passage 52. Here, the third room 54 is not limited to the structure of the first region space 48, the second region space 50 and the connecting passage 52.

A frame-shaped connecting portion 56 is disposed around the open portion of the first region space 48. A stepped fit portion 58 is formed inside the frame-shaped connecting portion 56 at the position which faces the first room 24 of the first member 10 in the state that the first member 10 and the third member 14 are connected. A plate-shaped filter 60 which has some thickness is attached to the stepped fit portion 58 by fitting. Here, the attaching position of the filter 60 is not limited to the third member 14 but also the first room 24 of the first member 10. Further, the attaching position of the filter 60 to the third member 14 is not limited to the position of the stepped fit portion 58. Here, the connecting position between the first room 24 of the first member 10 and the first region space 48 of the third member 14 has the largest section out of the first room 24, the second room 38 and the third room 54. It is preferred to attach the filter 60 at the position which section is largest, since the area of the filter 60 can be enlarged. Further, a resonator room 62 is formed at the third member 14 for connecting to the resonator 26 of the first member 10 as a concave.

It is possible to attach a control means 63 at the third member 14 for controlling various apparatuses such as the throttle valve 40 etc. Conventionally, the control means for controlling the throttle valve 40 etc. is disposed outside the engine room. In such a case, the treatment of the cable is demanding since the cable connects the various apparatuses such as the throttle valve 40 etc. in the engine room and the control means which is disposed outside of the engine room. However, by attaching the control means 63 at the third member 14 which is disposed in the engine room, the treatment of the cable between the control means 63 and the various apparatuses such as the throttle valve 40 etc. becomes easier.

Figure 5:
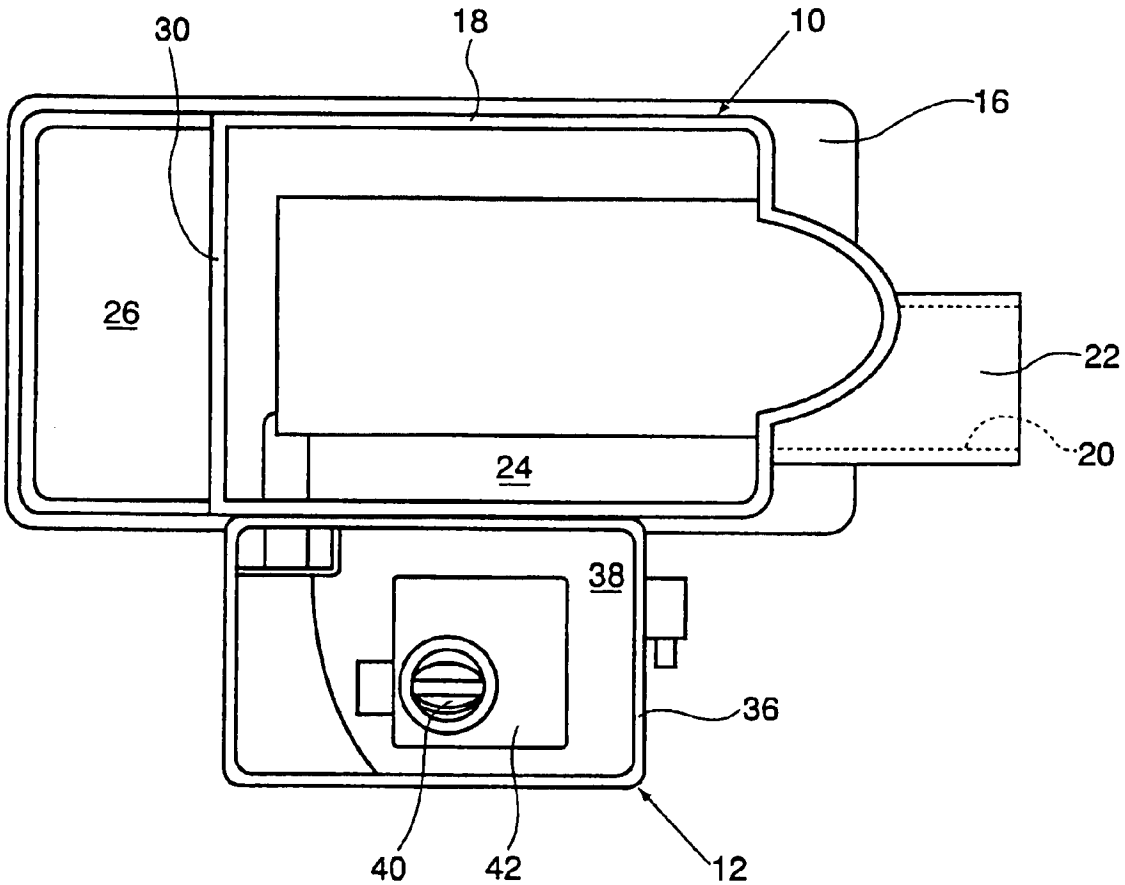
FIG. 5 is a plane view showing the state that the first member in FIG. 2 and the second member in FIG. 3 are connected and attached to an engine.

FIG. 5 is plane view of the state that the first member 10 and the second member 12 are fixed to the engine 16 by a known fix means, namely, a plane view of the state that the third member 14 is eliminated from FIG. 1. In the state of FIG. 1 and FIG. 5 that the first member 10 and the second member 12 are fixed to the engine 16, the second room 38 formed at the body 36 of the second member 12 is arranged to be at almost the same height as the first room 24 formed at the body 18 of the first member 10 and to be adjacent thereto.

When the first member 10 and the second member 12 are fixed to the engine 16, the first fit means 32 of the first member 10 which is shown in FIG. 2 and the second fit means 44 of the second member 12 which is shown in FIG. 3 are fitted. A known means such as convexo-concave is adopted to the first fit means 32 and the second fit means 44. By the fitting of the first fit means 32 and the second fit means 44, the deviation in the horizontal direction and the vertical direction between the first member 10 and the second member 12 can be suppressed to the minimum. In this embodiment, one location is arranged for fitting with the first fit means 32 and the second fit means 44. However, it is also possible to arrange a plurality of locations for fitting. Further, if it is necessary, a passage (not shown in drawings) to connect the first room 24 of the first member 10 and the second room 38 of the second member 12 can be formed at the fitting location between the first fit means 32 and the second fit means 44.

In the abovementioned explanation, the throttle body 42 is accommodated in the second room 38 of the second member 12. However, it does not necessarily have to be accommodated in the second room 38. The throttle body 42 can be attached to any place of the second member 12. For example, it is also possible to attach the throttle body 42 to the lower side of the second member 12, and attach the intake manifold 34 to the throttle body 42. However, by accommodating the throttle body 42 in the second room 38 of the body 36, the following advantages can be obtained. Cost for parts can be reduced by eliminating the connecting means which are conventionally needed. The assembling process of the throttle body 42 can be simplified. The intake air amount to the engine can be increased.

From the state of FIG. 5, the third member 14 to which the filter 60 is attached is fixed to the first member 10 and the second member 12. Consequently, the third member 14 closes the open portion of the first room 24 of the first member 10, the open portion of the resonator 26, and the open portion of the second room 38 of the second member 12. In the state that the first member 10 and the second member 12 are covered by the third member 14 as shown in FIG. 1, the first room 24 of the first member 10 and the first region space 48 (a part of the third room 54) of the third member 14 are connected through the filter 60. Further, the second region space 50 (a part of the third room 54) of the third member 14 and the second room 38 of the second member 12 are connected directly. In this manner, the first room 24 and the second room 38 are connected through the third room 54 by covering the first member 10 and the second member 12 with the third member 14. Here, since the first member 10 and the second member 12 are covered by the third member 14 which is a single piece, assembling time can be reduced.

Next, the flowing route of the intake air is explained. The air, namely the atmospheric air, which is introduced from the air introducing passage 20 of the duct portion 22 first flows into the first room 24 of the first member 10. Then, after eliminating dust etc. at the filter 60, the air reaches the first region space 48 which is a part of the third room 54 of the third member 14. In the third room 54, the air flows from the first region space 48 to the second region space 50 through the connecting passage 52. Then, the air reaches the second room 38 of the second member 12 from the second region space 50. The air which arrives at the second room 38 is supplied to the engine 16 through the throttle body 42 and the intake manifold 34.

With the intake apparatus of the present invention, the intake volume when excluding the air introducing passage 20, which can be compared with the conventional air cleaner, is the sum of the volumes of the first room 24 of the first member 10, the second room 38 of the second member 12, and the third room 54 (the first region space 48, the second region space 50 and the connecting passage 52) of the third member 14.

In the present invention, the intake apparatus comprises three members, which are the first member 10 which is attached above the engine 16, the second member 12 which is disposed at the position not above the engine 16, and the third member 14 which covers both the first member 10 and the second member 12. Then, the first room 24 is formed at the first member 10, the second room 38 is formed at the second member 12, and the third room 54 is formed at the third member 14. The first room 24, the third room 54, and the second room 38 are sequentially connected. In the present invention, the first room 24 which is formed at the first member 10 and the second room 38 which is formed at the second member 12 are connected by the third room 54 which is formed at the third member 14. Therefore, the second room 38 can be freely enlarged in the horizontal direction, namely, in the direction towards the first room 24. Then, all or a part of the second room 38 can be disposed adjacent to the height H of the first room 24. Further, since larger volume, namely larger intake air amount, than the prior art can be ensured by the first room 24, the second room 38 and the third room 54, the height of the first room 24 of the first member 10 can be lowered.

Figure 8:
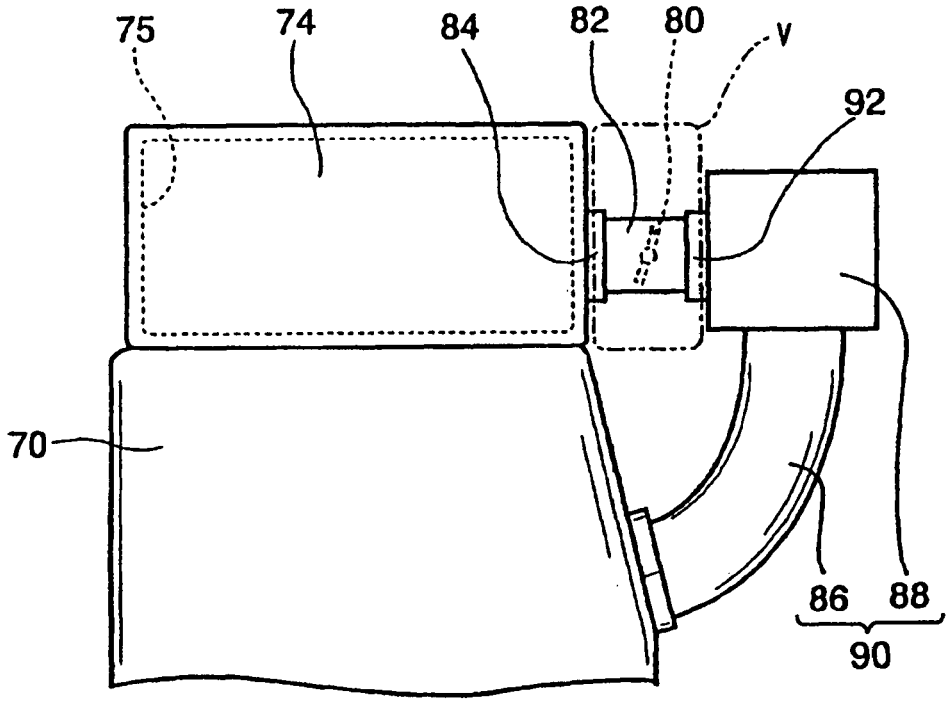
FIG.8 PRIOR ART
FIG. 8 is a front view of an intake apparatus of the prior art.
Figure 9:
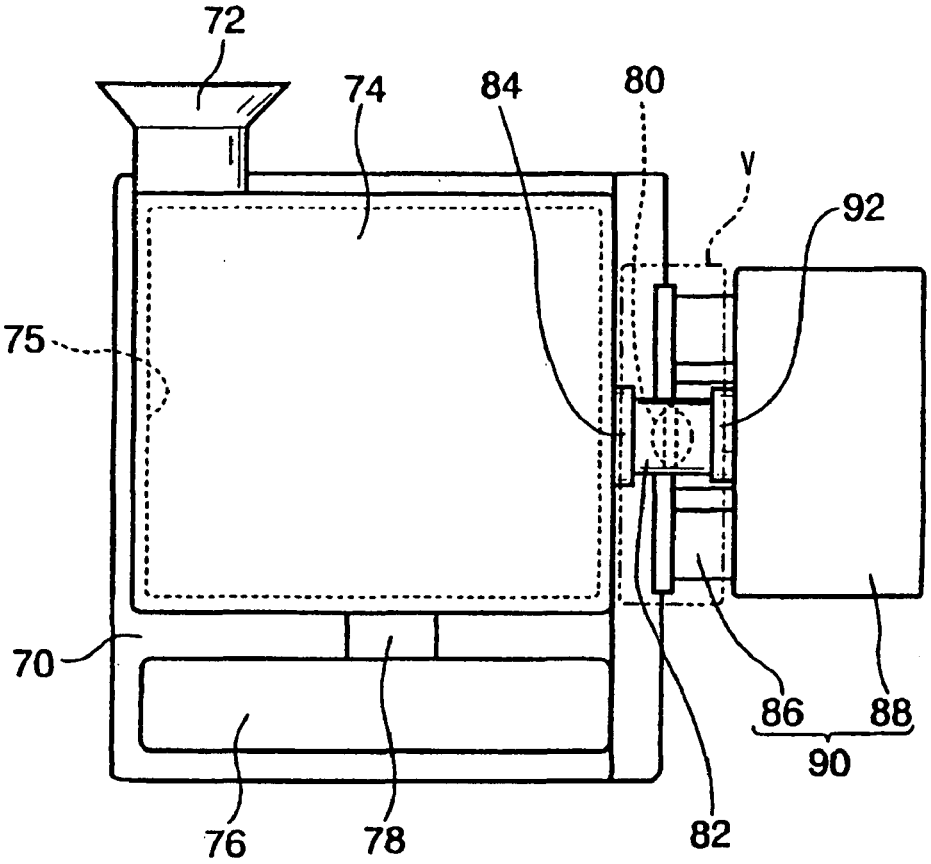
FIG.9 PRIOR ART
FIG. 9 is a plane view of the intake apparatus of the prior art.

The second room 38 of the second member 12 and a part (a space close to the first room 24) of the second region space 50 of the third room 54 of the third member 14 corresponds to the space V in FIG. 8 and FIG. 9 of the prior art. With the intake apparatus of the present invention, the space V which is not utilized conventionally can be newly utilized as an increased volume for the intake air amount.

In this manner, since the space V which is not utilized conventionally can be utilized as an increased volume for the intake air amount, the height of the intake apparatus of the present invention can be lowered than the height of the intake apparatus of the prior art. Namely, the total height of the first member 10 and the third member 14 of the present invention which position above the engine 16 can be lowered than the height of the conventional air cleaner which is disposed above the engine (the air cleaner 74 in FIG. 8). As a result, the clearance between the upper face of the third member 14 of the present invention and the engine hood can be larger than the clearance between the conventional air cleaner (the air cleaner 74 in FIG. 8) and the engine hood.

In the present invention, by dividing the volume for the intake air amount of the intake apparatus into three members, namely the first member 10, the second member 12, and the third member 14, the height of the first member 10 can be lowered and the position of the upper face of the third member 14 can be lowered. In this manner, by lowering the height of the first member 10 and the position of the upper face of the third member 14, the apparatus can be downsized as a whole. Further, by enlarging the intake volume, the intake noise can be suppressed. In the meantime, reduction in weight and cost can be achieved. In addition, the apparatus can be adopted to a mini car or a one-box car which engine room volume is more limited that a standard-sized car. Further, the collision safety can be greatly improved.

Figure 6:
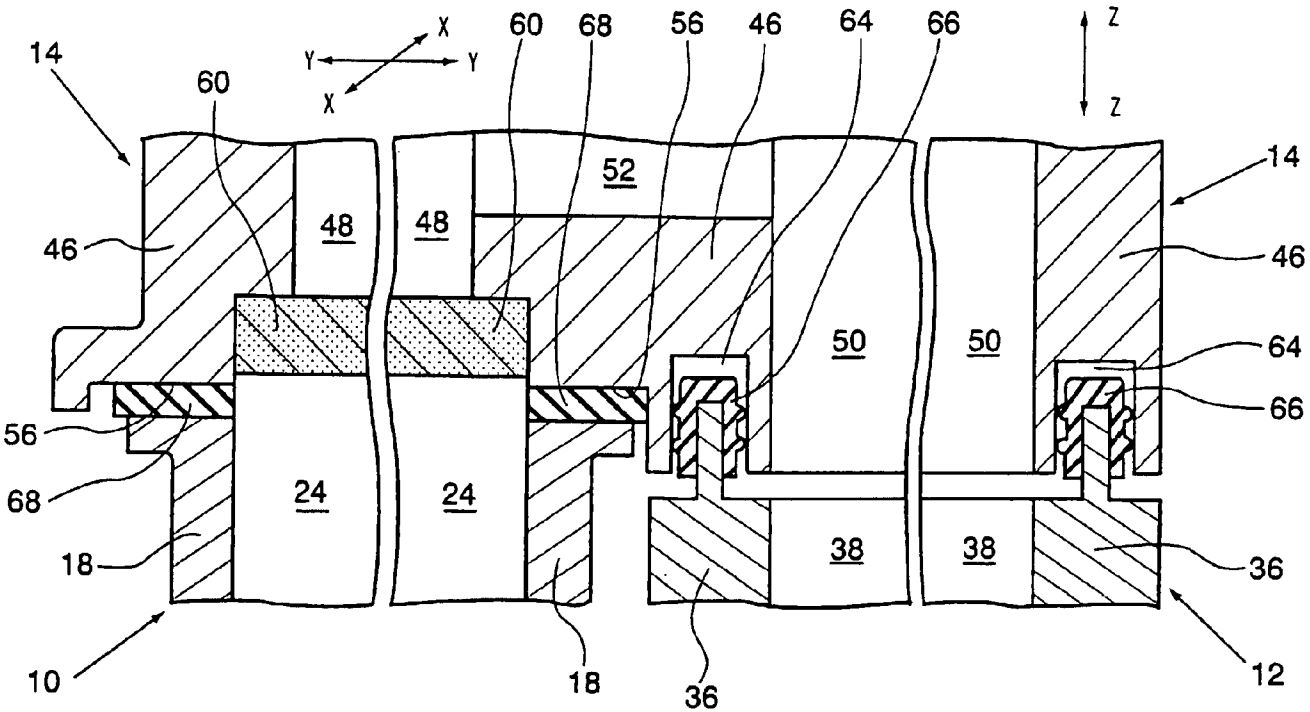
FIG. 6 is a sectional view showing the connecting portion of the first member and the third member and the connecting portion of the second member and the third member.

There occurs some deviation in the vertical direction and the horizontal direction between the first member 10 and the second member 12. When the first member 10 and second member 12 with some deviation are covered by the third member 14 which is one piece, the air tightness at each connecting portion must be ensured. A sectional view of the state that the first member 10 and the second member 12 are covered by the third member 14 is shown in FIG. 6. A recess portion 64 is formed at the connecting portion of the third member 14 with the second member 12. On the other hand, a convex-shaped seal member 66 is attached to the connecting portion of the second member 12 with the third member 14. When the third member 14 covers the second member 12, the recess portion 64 is fitted to the convex-shaped seal member 66. In this manner, the air tightness at the connecting face between the second member 12 and the third member 14 can be maintained by the side face of the convex-shaped seal member 66. The side face of the convex-shaped seal member 66 can perform the sealing regardless of the depth of fitting of the convex-shaped seal member 66 to the recess portion 64. Therefore, the air tightness can be maintained even when the fitting depth varies. In accordance with the fitting depth, the deviation in the height direction, namely in the vertical direction, between the second member 12 and the third member 14 can be adjusted. Here, it is also possible to attach the convex-shaped seal member 66 at the third member 14 and form the recess portion 64 at the second member 12.

The connecting portion between the first member 10 and the third member 14 is on a plane which is parallel to the perpendicular direction (X-X direction and Y-Y direction in FIG. 6) to the vertical direction (Z-Z direction in FIG. 6) for fitting of the recess portion 64 and the seal member 66. A seal member 68 is sandwiched by the horizontal connecting portions of the first member 10 and the third member 14. The seal member 68 is contacted to the frame-shaped connecting portion 56 of the third member 14. The air tightness at the connecting face of the first member 10 and the third member 14 can be maintained by the seal member 68. Here, in the state that the seal member 68 is sandwiched, the first member 10 and the third member 14 are designed to move relatively in the horizontal direction even when some deviation occurs between the first member 10 and the third member 14 in the horizontal direction, namely in the crosswise direction (X-X direction and Y-Y direction in FIG. 6). In this manner, the deviation between the first member 10 and the third member 14 in the horizontal direction can be adjusted and allowed.

As mentioned above, the first member 10 can be displaced in the horizontal direction (X-X direction and Y-Y direction in FIG. 6) against the third member 14, and the second member 12 can be displaced in the vertical direction (Z-Z direction in FIG. 6) against the third member 14. With this structure, even when the phase of the first member 10 and the second member 12 are unstable, namely, even when some deviation exists in the horizontal direction and the vertical direction, the air tightness at both connecting portions between the first member 10 and the third member 14 and between the second member 12 and the third member 14 can be maintained. Here, in FIG. 6, the second member 12 and the third member 14 are free to move in the vertical direction, and the first member 10 and the third member 14 are free to move in the horizontal direction. However, on the contrary, it is also possible to set the second member 12 and the third member 14 to move freely in the horizontal direction, and set the first member 10 and the third member 14 to move freely in the vertical direction.

Figure 7:
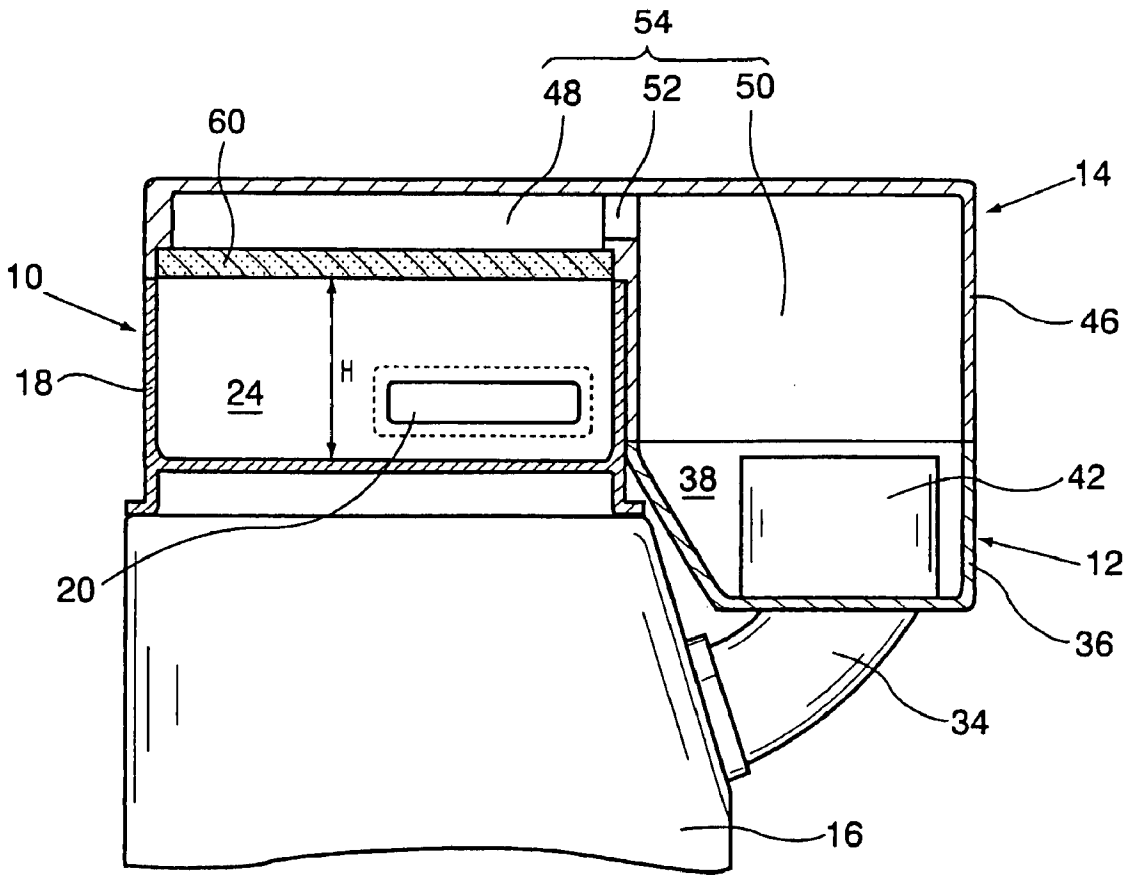
FIG. 7 is a sectional view showing another embodiment of the intake apparatus of the present invention.

FIG. 1 shows the state that the second room 38 of the second member 12 is disposed adjacent to the first room 24 of the first member 10. However, it is also possible that parts of both the third room 54 of the third member 14 and the second room 38 of the second member 12 are disposed adjacent to the first room 24 at the height H, as shown in FIG. 7. Further, although it is not shown in figures, it is also possible that only the third room 54 of the third member 14 is disposed adjacent to the first room 24. Namely, it is possible to dispose at least one of the second room 38 and the third room 54 adjacent to the first room 24.

INDUSTRIAL APPLICABILITY

In the present invention, the first room of the first member and the second room of the second member are connected by the third room which is formed at the third member. With this structure, the second room can be enlarged and can be disposed adjacent to the first room at the same height. The position of the second room which is adjacent to the first room is in the space V which is not conventionally utilized but is efficiently utilized as the intake volume in the present invention. Conventionally, space V is at the side of the air cleaner where a throttle body is disposed. In the present invention, the height of the first member which is disposed above the engine can be lowered. Then, the clearance between the engine hood and the upper face of the third member which is disposed above the first member can be greatly enlarged than the prior art. Consequently, the intake noise can be greatly suppressed and the collision safety can be greatly improved. Further, the apparatus can be adopted to various types of automobiles. Furthermore, since the clearance between the first member and the engine hood is enlarged, the impact to a pedestrian can be reduced if the vehicle hits a pedestrian. In addition, reduction in size and weight can be performed by lowering the height of the intake apparatus as a whole. In the mean time, three members as the first member, the second member, and the third member are main components of the present invention. Therefore, the connecting member which is conventionally needed can be eliminated, and cost reduction can be achieved due to reduction in parts count and assembling time.

The invention claimed is:

1. An intake apparatus for supplying air to an engine comprising:

a first member which is disposed above the engine having a first room connecting to the atmospheric air;

a second member having a throttle body and a second room which is connected to the engine; and a third member for covering said first room of said first member and said second room of said second member having a third room to connect said first room and said second room;

wherein at least one of said second room and said third room is disposed adjacent to said first room.

2. The intake apparatus according to claim 1, wherein said throttle body is disposed in said second room.

3. The intake apparatus according to claim 1, wherein said second room of said second member is connected to the engine through said throttle body and an intake manifold.

4. The intake apparatus according to claim 1, wherein said first member comprises a resonator which connects to said first room.

5. The intake apparatus according to claim 1, wherein said first member serves also as a cylinder head cover of the engine and is attached to the engine.

6. The intake apparatus according to claim 1, wherein said first room is formed as a concave of said first member.

7. The intake apparatus according to claim 1, wherein said second room is formed as a concave of said second member.

8. The intake apparatus according to claim 1, wherein said third member comprises a first region space which connects to said first room, a second region space which connects to said second room, and a connecting passage which connects said first region space and said second region space.

9. The intake apparatus according to claim 8, wherein said first region space and said second region space are formed as a concave at said third member.

10. The intake apparatus according to claim 1, wherein a filter is disposed in said first room of said first member.

11. The intake apparatus according to claim 1, wherein a filter is attached to said third member at a position facing said first room.

12. The intake apparatus according to claim 1, wherein a control means is attached to said third member.

13. The intake apparatus according to claim 1, wherein said first member has a first fit means and said second member has a second fit means for fitting with said first fit member.

14. The intake apparatus according to claim 1:

wherein a recess portion is formed at one of said second member and said third member, and a convex-shaped seal member is attached to the other of said second member and said third member, at the connecting portion of said second member and said third member, and said seal member is fitted to said recess portion while the depth of fitting is adjustable;

wherein the connecting portion between said first member and said third member is on a plane which is parallel to the perpendicular direction to the fitting direction of said recess portion and said convex-shaped seal member; and wherein a seal member is sandwiched at the connecting portion of said first member and said third member which are free to relatively be adjusted in the parallel direction of each member at the sandwiching position.

15. The intake apparatus according to claim 1:

wherein a recess portion is formed at one of said first member and said third member, and a convex-shaped seal member is attached to the other of said first member and said third member, at the connecting portion of said first member and said third member, and said seal member is fitted to said recess portion while the depth of fitting is adjustable;

wherein the connecting portion between said second member and said third member is on a plane which is parallel to the perpendicular direction to the fitting direction of said recess portion and said convex-shaped seal member; and wherein a seal member is sandwiched at the connecting portion of said second member and said third member which are free to relatively be adjusted in the parallel direction of each member at the sandwiching position.

* * * * *